US005280417A

United States Patent [19]

Hall et al.

[11] Patent Number: 5,280,417

[45] Date of Patent: Jan. 18, 1994

[54] LOW VOLTAGE LIGHT FIXTURE

[75] Inventors: Milly S. Hall, Dallas, Tex.; Donald L. Rohrs, Overland Park, Kans.; Kung C. Hung, Richmond, Canada

[73] Assignee: The Brinkmann Corporation, Dallas, Tex.

[21] Appl. No.: 742,917

[22] Filed: Aug. 9, 1991

[51] Int. Cl.[5] ..... H01R 33/00

[52] U.S. Cl. ..... 362/226; 362/153; 362/238; 362/249; 362/391; 362/427; 362/431; 439/410

[58] Field of Search ..... 362/153, 153.1, 226, 362/238, 249, 391, 431, 427; 439/409, 410, 602

[56] References Cited

U.S. PATENT DOCUMENTS

| | | | |
|---|---|---|---|
| 1,171,710 | 2/1916 | Freixas . | |
| 2,175,844 | 4/1937 | Laystrom | 173/328 |
| 2,408,045 | 9/1946 | Cottrell | 173/340 |
| 2,692,374 | 10/1954 | Carson | 339/99 |
| 2,769,154 | 10/1956 | Greenbaum | 339/99 |
| 2,797,310 | 6/1957 | Moore | 362/311 |
| 2,802,083 | 8/1957 | Lapeyre | 200/298 |
| 3,015,720 | 1/1962 | Silverman | 362/431 |
| 3,456,104 | 7/1969 | Williams | 362/362 |
| 3,634,599 | 1/1972 | Kliewer | 174/52 R |
| 3,705,302 | 12/1972 | Judge et al. | 362/222 |
| 3,786,461 | 1/1974 | Jamison | 340/227.1 |
| 4,081,641 | 3/1978 | Piber | 200/153 LA |
| 4,360,242 | 11/1982 | Poliak et al. | 339/99 R |
| 4,438,484 | 3/1984 | Winden | 362/267 |
| 4,631,650 | 12/1986 | Ahroni | 362/249 |
| 4,638,411 | 1/1987 | Trainor | 362/145 |
| 4,653,829 | 3/1987 | LaMont | 339/97 L |
| 4,768,139 | 8/1988 | Poppenheimer | 362/431 X |
| 4,774,648 | 9/1988 | Kakuk et al. | 362/431 X |
| 4,781,616 | 11/1988 | Yu | 439/409 |
| 4,814,961 | 3/1989 | O'Brien et al. | 362/319 |
| 4,826,448 | 5/1989 | Maddock | 439/409 |
| 4,870,548 | 9/1989 | Beachy et al. | 362/145 |
| 4,874,329 | 10/1989 | Yu | 439/409 |
| 4,996,636 | 2/1991 | Lovett | 362/226 X |
| 5,086,379 | 2/1992 | Denison et al. | 362/431 X |

FOREIGN PATENT DOCUMENTS

0101147A3 2/1984 European Pat. Off. .

OTHER PUBLICATIONS

Brochure entitled "Noma Garden Lighting/Eclairage de jardin", (undated), Noma International, Inc., Forest Park, Ill.

Brochure entitled "Lightolier Night Magic: The Landscape Lighting System", dated 1988, Lightolier, Inc., Secaucus, N.J.

Brochure entitled "Intermatic Malibu Dimension II: A New Approach to Low Voltage Lighting that Enhances your SKU Profitability", dated Feb. 1988, Intermatic, Inc., Spring Grove, Ill.

Brochure entitled "Intermatic Malibu Bollard Accent Lights", dated Jun. 1990, Intermatic, Inc., Spring Grove, Ill.

Brochure entitled "Hadco Nightlife Landscape Lighting", (undated), Hadco, Inc., Littlestown, Pa.

Brochure entitled "Hadco Nightlife Landscape Lighting Supplement", (undated), Hadco, Inc., Littlestown, Pa.

*Primary Examiner*—Stephen F. Husar

*Attorney, Agent, or Firm*—Mitchell P. Brook; Philip Y. Dahl

[57] ABSTRACT

An outdoor light fixture that receives power from an external power source through an insulated wire and that has an angular displacement connector with conductive prongs that pierce the wire insulation in order to achieve a conductive contact.

18 Claims, 10 Drawing Sheets

LOW VOLTAGE LIGHT FIXTURE

BACKGROUND OF THE INVENTION

The present invention relates to light fixtures and more particularly low voltage outdoor light fixtures that receive current through wires connected to an external power source.

Low voltage outdoor light fixtures are widely known. Such fixtures typically are used to illuminate gardens, outdoor walkways, driveways, patios and other areas or to spotlight sculptures, trees, structures and other objects. Typically, low voltage outdoor light fixtures are constructed of metal or plastic, and have a power source, a stake suitable for being inserted into the ground and for supporting the other components of the light fixture, a light bulb, and a globe that protects the light bulb, diffuses light emitted from the light bulb and provides decoration. In some fixtures, the power source includes solar panels that are used to generate electricity to power the light bulb. In other fixtures, a low voltage power supply provides typically about 12 volts AC through a wire that runs—e.g., underground—from the low voltage power supply to the light fixtures.

Generally, more than one fixture may be connected to a single low voltage power supply in the known type of power arrangement. In such cases, the wire carrying current from the power supply typically is laid underground such that it emerges from the ground to connect to a light fixture and then runs further underground until it emerges to connect to the next fixture and so forth until all of the desired light fixtures are wired to the power supply.

Various apparatus are known for connecting the wire running from the power supply to a light fixture. A commonly used connection scheme is a sliding connector, which is described in U.S. Pat. No. 4,774,648. The connector incorporates a stake that has a top with a hooked groove, which includes a pair of upwardly protruding L-shaped guides suitable for slidably receiving laterally protruding legs near the bottom of the assembly used for mounting the bulb and the globe (bulb/globe assembly). In such a scheme, the wire is looped over the top of the stake and nestles in the groove between upwardly extending guides, then the bulb/globe assembly—which has downwardly protruding pointed conductive prongs—is slid into place such that, when a connection is successfully made, the pointed conductive prongs pierce the wire's insulation and provide a conductive contact.

Other types of sliding connectors are also known. For example, another known sliding connector has hooked guides protruding either directly from the bulb/globe assembly or from a post extending from the bulb/globe assembly. The hooked guides are adapted to receive the top of the stake and the conducting prongs are situated between the hooked guides. In this scheme, the wire is looped through the hooked guides and then the top of the stake, or a retaining tab, is slid onto the bulb/lens assembly between the guides.

In another known scheme for connecting the wire to a fixture the wire terminates at the light fixture and a pair of contacts is crimped to the end of the wire. Such a crimped connector is discussed in U.S. Pat. No. 4,814,961.

Sliding connectors possess a number of known disadvantages. Difficulty in making a conductive connection is one such disadvantage. Often in installation of light fixtures using sliding connectors, the pointed conductive prongs do not adequately pierce the insulation of the wire, so a conductive contact is not made. The installer therefore must slide the connector components apart, re-align the wire and then slide the components back together. This process must be repeated until a conductive contact is made.

A further disadvantage of sliding connectors is that a longitudinal incision may be made in the wire's insulation as the contacts are slid into place. This incision is longer than necessary to make a conductive contact. A further related disadvantage is that each time the installer must repeat the sliding process—if multiple attempts to form a conductive contact are required—the damage to the insulation may be increased.

A still further disadvantage of sliding connectors is that a shearing force can be applied by the pointed conductive prongs.

Yet another disadvantage is that the wire insulation may be damaged by the incision, which increases the risks of short circuits, sparking and other known disadvantages inherent in exposed wiring.

Crimped connectors also possess a number of known disadvantages. One such disadvantage is that connections to multiple light fixtures cannot be achieved with one uninterrupted wire because the wire must be cut so the crimped connection can be made at the loose end.

A further disadvantage of crimped connectors is that installation is relatively complicated and time consuming.

SUMMARY OF THE INVENTION

The present invention alleviates to a great extent the disadvantages of the prior art by providing an outdoor light fixture that comprises a stake and a bulb assembly which together incorporate the components of an angular displacement connector for making conductive contact with a wire that is capable of carrying electric current. The angular displacement connector comprises: a guide at the top of the stake, which is constructed to orient the wire in a desired position; two pointed conductive prongs that protrude from the bottom of a bulb assembly; and a hinge apparatus for allowing the bulb assembly to pivot about the hinge between an open and closed position such that the pointed conductive prongs pierce the wire's insulation when the hinge is in the closed position.

In a preferred embodiment, the outdoor light fixture of the present invention also comprises a low voltage power supply that provides about 12 volts AC through the wire; a channel at the top of the stake for orienting the wire; tabs on the sides of the stake that are arranged to hold the wire in place; a covering to shield the wire on those portions of the stake that are above ground; a light bulb; and a lens for refracting or diffusing light emitted from light bulb in a pleasing fashion. In another preferred embodiment, the bulb assembly and hinge mechanism are constructed such that the bulb assembly can be detached from the stake, and in the closed position, the bulb assembly is secured with a snap-type lock.

An advantage of the present invention is that a substantially compressive force is applied by the pointed conductive prongs on the wire to pierce the wire insulation rather than horizontal or shearing forces.

Other advantages of the present invention are that the skill level or dexterity needed to achieve a conductive connection is reduced, the amount of manual force that must be applied to pierce the wire insulation is reduced, the ease of making a conductive connection is increased and the number of attempts needed to achieve a conductive connection is reduced. A related advantage is that installing light fixtures with the angular displacement connector of the present invention is fast and uncomplicated.

A further advantage of the present invention is that the wire insulation is pierced in a substantially compressive direction, so longitudinal tears and incisions in the insulation are reduced.

Yet another advantage of the present invention is that the risks of shorts, sparking and other disadvantages inherent in exposed wiring are reduced.

A related advantage is that installing light fixtures with the angular displacement connector of the present invention is fast and uncomplicated.

It is therefore an objective of the present invention to provide a light fixture that achieves a conductive contact with an insulated wire using an angular displacement connector.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout and in which.

DETAILED DESCRIPTION OF THE INVENTION

Figure 1:
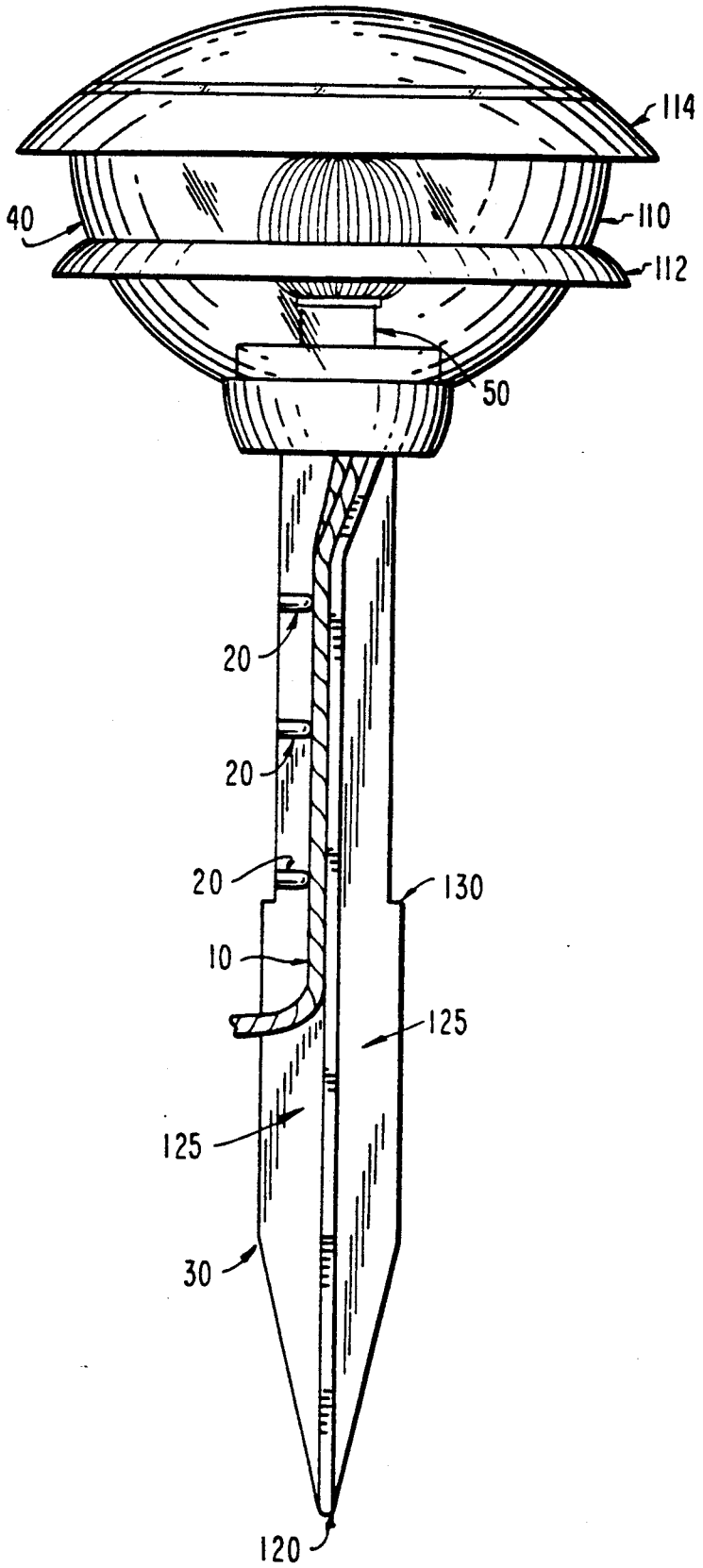
FIG. 1 is a front view of a light fixture according to the present invention.

FIGS. 1–4 illustrate an outdoor light fixture according to the present invention. Electric current is provided by insulated wire 10. The wire is retained in place by tabs 20 that protrude from stake 30. A globe assembly 40 and bulb assembly 50 are mounted on top of the stake 30. The bulb assembly 50 and stake 30 are constructed such that an angular displacement connector 100 creates a conductive contact between the bulb assembly 50 and the wire 10.

Any type of globe assembly 40 that permits light to be emitted may be used. The globe assembly illustrated in FIG. 1 has, inter alia, a clear pane 110, a louvre 112 and top 114. Various types of globe assemblies that may be used in other embodiments of the present invention are illustrated in co-pending, commonly-assigned United States design patent application Ser. Nos. 696,521, 696,528, 696,530, 696,531, all filed on May 7, 1991. The globe assembly 40 is mounted on the stake 30. Any mounting and locking mechanism may be used, such as lugs 116, hooks, tabs, and snap detent recesses 118 and detent bumps.

The stake 30 may take any shape and be constructed of any material such that the stake can be inserted into the ground in a stable fashion and support the other components of the light fixture. It is preferred that the stake 30 be constructed of a material that resists decay and corrosion because preferably the light fixtures of the present invention are used outdoors. Preferably the stake 30 is constructed of a high impact, weather and ultraviolet light resistant polymer, but other materials, such as stainless steel or aluminum may be used.

The stake 30 preferably has a pointed tip 120 to ease insertion into the ground. The stake also preferably has an "X" shaped cross-section to provide strength and to provide convenient stake channels 125 for guiding the wire 10. Other cross-section patterns such as "U", circular, diamond or rectangular shapes may be used. Tabs 20 help to hold the wire 10 in place. In typical use, a portion of the stake will be underground and the remainder will be above-ground. The portion underground anchors the stake 30 in position. It is therefore important in use that a sufficient portion of the stake 30 be buried. Preferably, the stake 30 is constructed with markings, such as indentations 130, indicating the portion of the stake, below the markings, intended to be buried. In one embodiment, the tabs 20 are located on the portion of the stake 30 intended to be above-ground. A protective cover may be wrapped around the stake to protect the wire from the atmosphere, animals and yard machinery such as lawn mowers and weed cutters. Preferably, the protective cover covers the entire portion of the stake that is intended to be above-ground.

Multiple light fixtures may be connected to a single power supply. A single two conductor wire 10 is used to provide power to each of the light fixtures as follows: the wire is run underground from the power supply to the first light fixture; the wire then is run up the stake 30 of the first light fixture, preferably in a stake channel 125; the wire is conductively connected to the light fixture using the angular displacement connector 100; the wire is run down the stake 30, preferably through another stake channel 125, until it is below ground; the wire then is run underground to the next light fixture and is connected as described above. These steps are repeated until each light fixture desired is connected.

Any source of electric power may be used, such as typical electric outlets in American and European homes. In the preferred embodiment, a low voltage power source is used. In this embodiment, wire 10 preferably is connected to a low voltage power supply. An acceptable low voltage power supply provides less than 40 volts AC through the wire and preferably generally provides 12 volts AC through the wire. In addition, a timing mechanism, such as an electronic timer or a photosensor may be incorporated which can be set to turn the light fixtures on and off at desired times or light levels. Although aspects of the present invention may also be applied to higher voltage power sources and to indoor light fixtures, this description will focus upon the preferred application, that being low voltage outdoor light fixtures.

Figure 2:
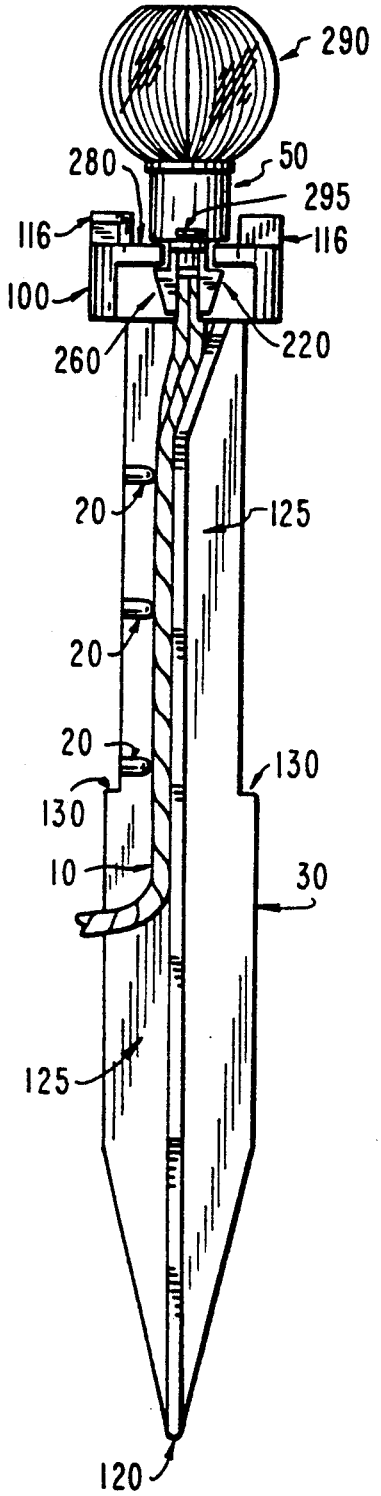
FIG. 2 is the light fixture of FIG. 1 with its globe assembly removed.
Figure 3:
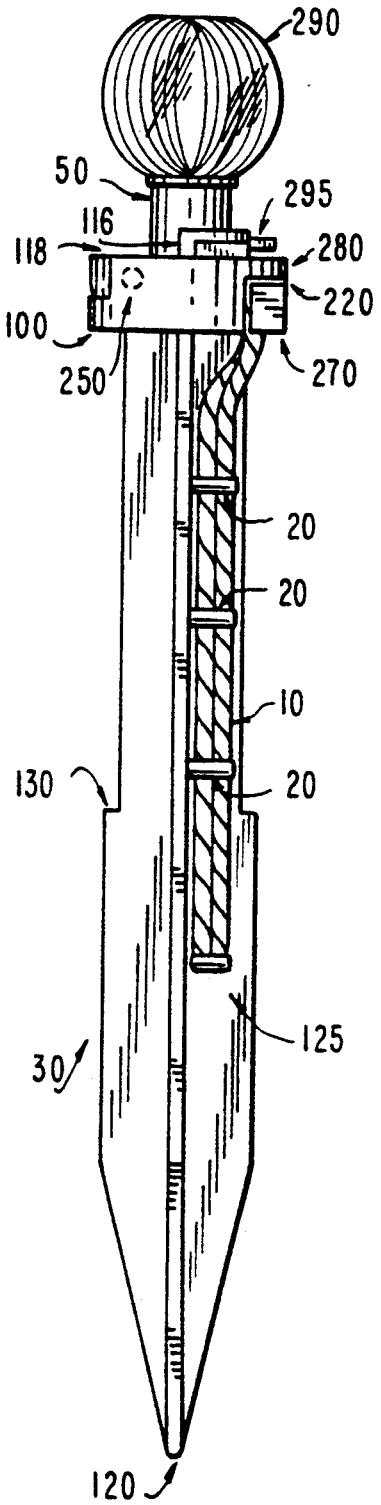
FIG. 3 is a side view of the light fixture of FIG. 2.
Figure 4:
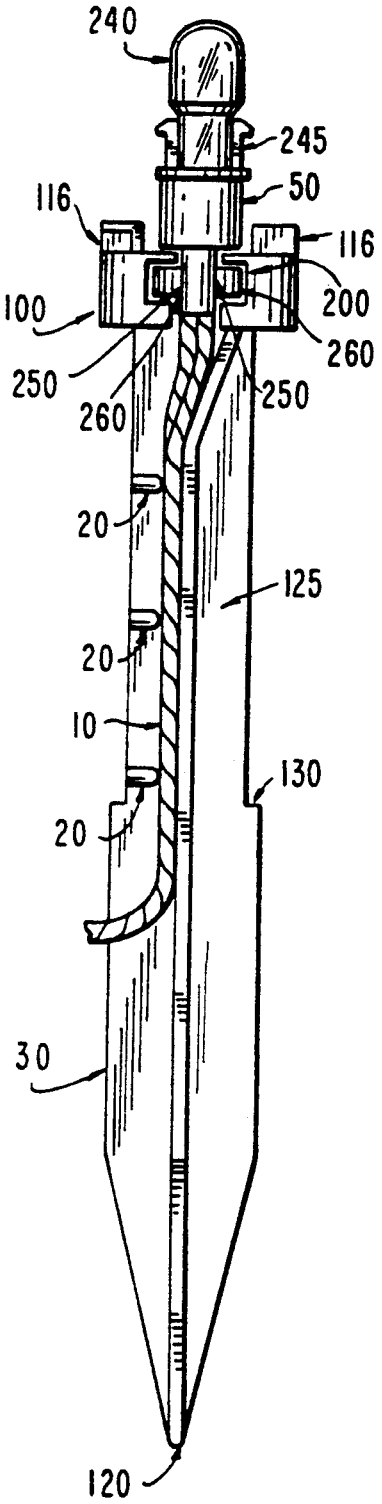
FIG. 4 is a rear view of the light fixture of FIG. 2 with the inner refracting lens removed.
Figure 5:
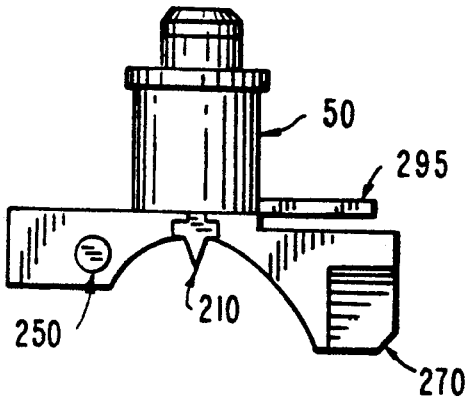
FIG. 5 is a side view of the bulb assembly of a light fixture according to the present invention.
Figure 6:
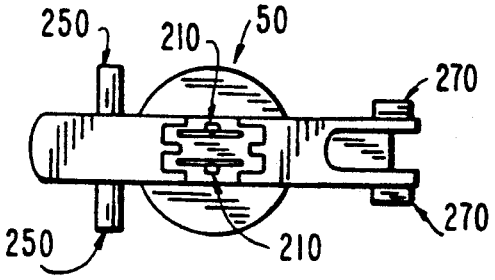
FIG. 6 is a bottom view of the bulb assembly of a light fixture according to the present invention.
Figure 7:
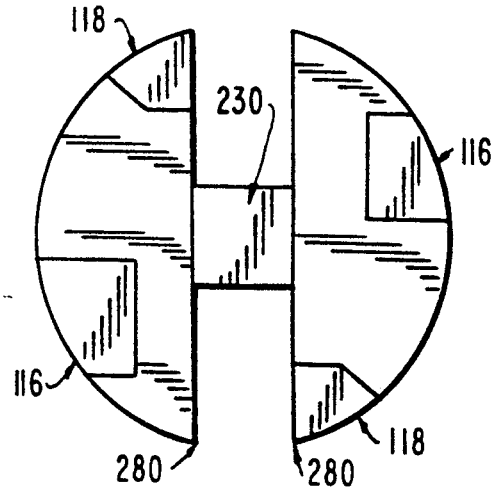
FIG. 7 is a top view of the stake of a light fixture according to the present invention.
Figure 8:
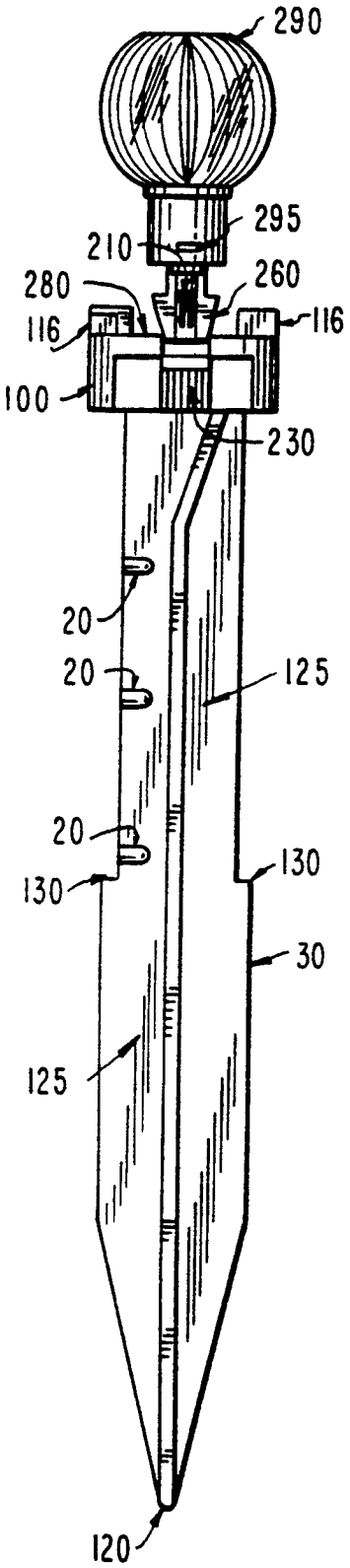
FIG. 8 is the light fixture of FIG. 2 with the bulb assembly in an open position.

The angular displacement connector 100 includes as its basic components the bulb assembly 50, a hinge 200, conductive prongs 210 and a securing means 220 for securing the bulb assembly 50 in a closed position. In operation, the bulb assembly is connected to the stake 30 through the hinge 200 such that the bulb assembly 50 can pivot between an open position and a closed position. FIGS. 2–4 depict the bulb assembly 50 in the closed position and FIG. 8 depicts the bulb assembly 50 in a partially open position. The wire is threaded through a channel 230, or other means for orienting it into position, such as guides, prongs or tines, at the top of the stake 30. Then when the bulb assembly 50 is pivoted about the hinge 200 to the closed position, the conductive prongs 210 protruding from the bulb assembly 50 impinge upon the wire 10 in a generally compressive fashion. When the bulb assembly 50 is in the closed position, the prongs 210 pierce the wire's insulation and achieve a conductive contact.

The conductive prongs 210 receive electricity to power the light bulb 240. In the preferred embodiment, there are two conductive prongs 240 mounted in the bulb assembly 50 in conductive contact with the light bulb mounting assembly 245 for mounting the light bulb 240. In one embodiment, the conductive contact with the light bulb 240 is achieved by wires connecting the conductive prongs 210 to the light bulb mounting assembly 245. In an alternate embodiment, the mounting assembly 245 is soldered or otherwise connected directly to the conductive prongs 210 to achieve conductive contact. The light bulb mounting assembly 245 may incorporate apparatus for securing a light bulb to the light fixture of the present invention such that power is transferred to light bulb 240 from conductive prongs 210.

The insulation-piercing portion of each conductive prong 210 is constructed such that it is sharp and rigid enough to pierce the insulation on the wire being used when the bulb assembly 50 is pivoted into the closed position. In the preferred embodiment, there are two spaced apart pointed prongs 210 mounted to the bulb assembly 50 such that the insulation-piercing portions of the prongs 210 protrude from the bottom of the bulb assembly. In use, as the bulb assembly 50 is pivoted about the hinge 200 towards the closed position, the pointed portions of the prongs 210 first contact the insulation covering wire 10, which is in the channel 230 near the top of the stake 30 and then, as bulb assembly is further pivoted, the pointed portions of the prongs 210 exert a substantially compressive force on the insulation covering the wire 10 such that the insulation is pierced and the prongs 210 achieve a conductive contact with wire 10.

The top portion of the stake 30 is adapted to receive and orient the wire 10 such that when the bulb assembly 50 is pivoted to the closed position, the conductive prongs 210 can pierce the insulation and form a conductive contact. Any type of guide or mounting means may be used to position the wire, such as posts, tabs, tines or L-shaped guides. In the preferred embodiment, a channel 230 is molded into the top of the stake 30. In use, the wire is threaded up a stake channel 125 and then is folded over the top of the stake 30 through the channel 230 and then down a stake channel 125. Preferably, the stake has more than one stake channel 125 such that the wire may nestle in one stake channel as it is threaded up the stake to the angular displacement connector and is threaded through another stake channel running down the stake away from the angular displacement connector 100.

Any type of hinge that allows the bulb assembly 50 to pivot from the open to closed position may be used. In the preferred embodiment, the hinge 200 is constructed such that the bulb assembly 50 may readily be detached from the stake 30. Such a hinge enables the wire 10 to be threaded through the channel 230 when the bulb assembly 50 is detached, thereby making it easier to orient the wire as desired. As depicted in FIGS. 4–8, it is preferred that components of the hinge 200 be on both the stake 30 and the bulb assembly 50 and be arranged such that the bulb assembly 50 may be detached from the stake 30. Hinge posts 250 protrude from the sides to the bulb assembly 50. They are shaped and oriented such that they can be slid into the slots 260 in the rear of the top portion of the stake 30 and such that when they are slid into the slots 260, the bulb assembly 50 can pivot about an axis formed by the posts 250.

Alternatively, other types of hinges can be used, including: a "living" hinge in which the bulb assembly is molded to the stake; and a three piece hinge, like a door hinge, in which one part of the hinge is on the stake, another part is on the bulb assembly and a connector, such as a pin, connects the two pieces together such that the bulb assembly can pivot, but is attached to the stake through the hinge.

It is preferred that the bulb assembly be provided with a locking mechanism which holds it in place when it is in the closed position. Although any type of snap, strap, or other retaining means may be used, it is preferred that a closure snap 260, as depicted in FIGS. 2, 3, 5, 6 and 8 be used. In this preferred embodiment, two snap prongs 270 are attached to the front portion of the bulb assembly 50. In the closed position, the snap prongs 270 fit beneath the front ledges 280 of the top of the stake 30 such that the bulb assembly 50 can not pivot about the posts 250 to an open position. In operation, the locked bulb assembly may be pivoted to an open position by compressing the two snap prongs 270 together such that the ledges 280 are cleared by the prongs 270.

It is preferred that a lens be included in the light fixture such that light is dispersed in a pleasing fashion and large glaring hot spots are diminished. In one embodiment of the present invention, the globe assembly 40 may provide a diffusing effect, for example, by incorporating frosting on its inner or outer surface or by being constructed of a translucent material. Alternatively, as disclosed in more detail co-pending commonly-assigned U.S. patent application Ser. No. 07/742,916, filed concurrently herewith, a refracting lens 290 is slipped over the bulb 240 and mounted to the bulb assembly 50 inside the globe 40.

Figure 9:
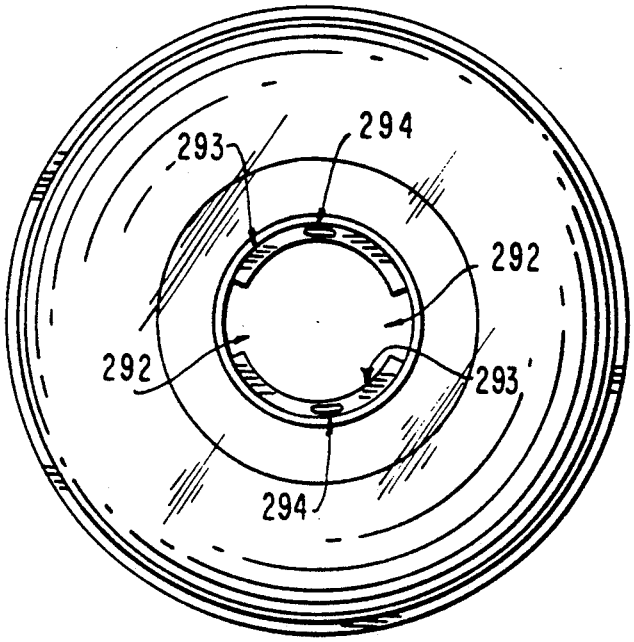
FIG. 9 is a bottom view of a globe assembly.
Figure 10:
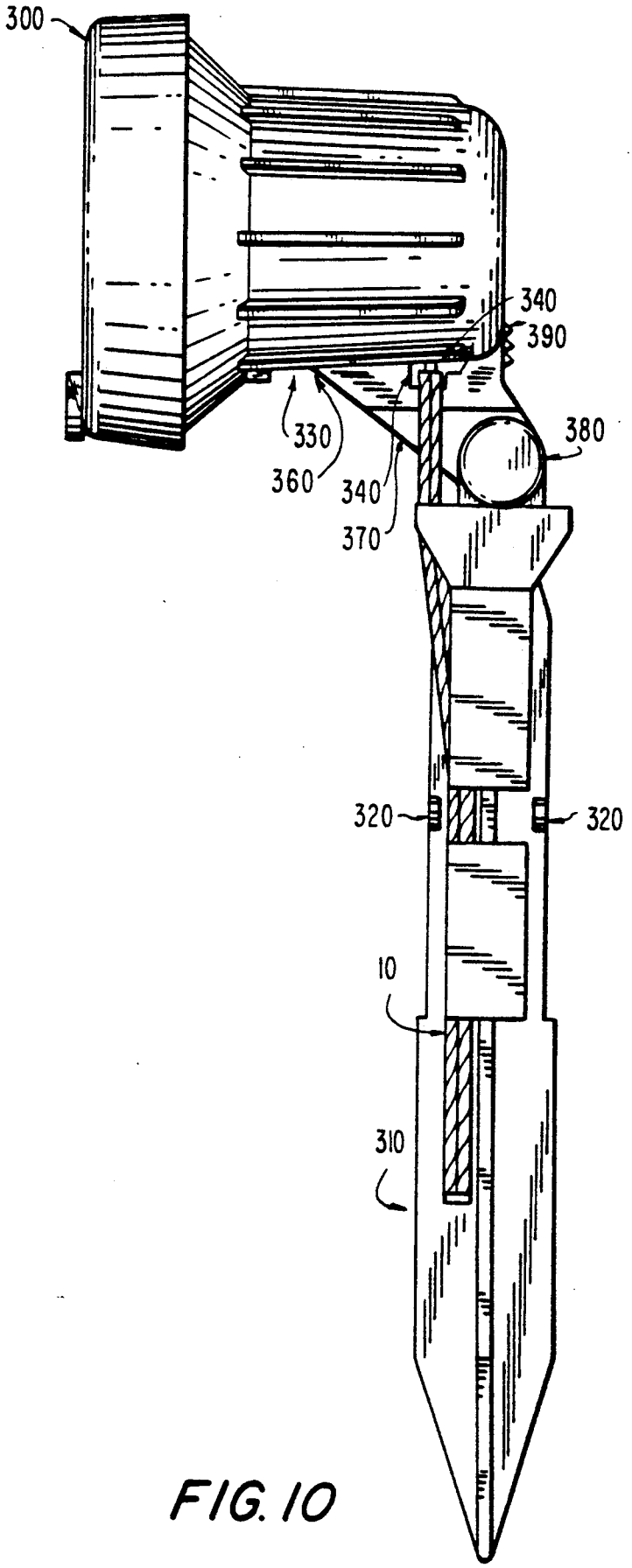
FIG. 10 is a side view of a floodlight embodiment of a light fixture according to the present invention.
Figure 11:
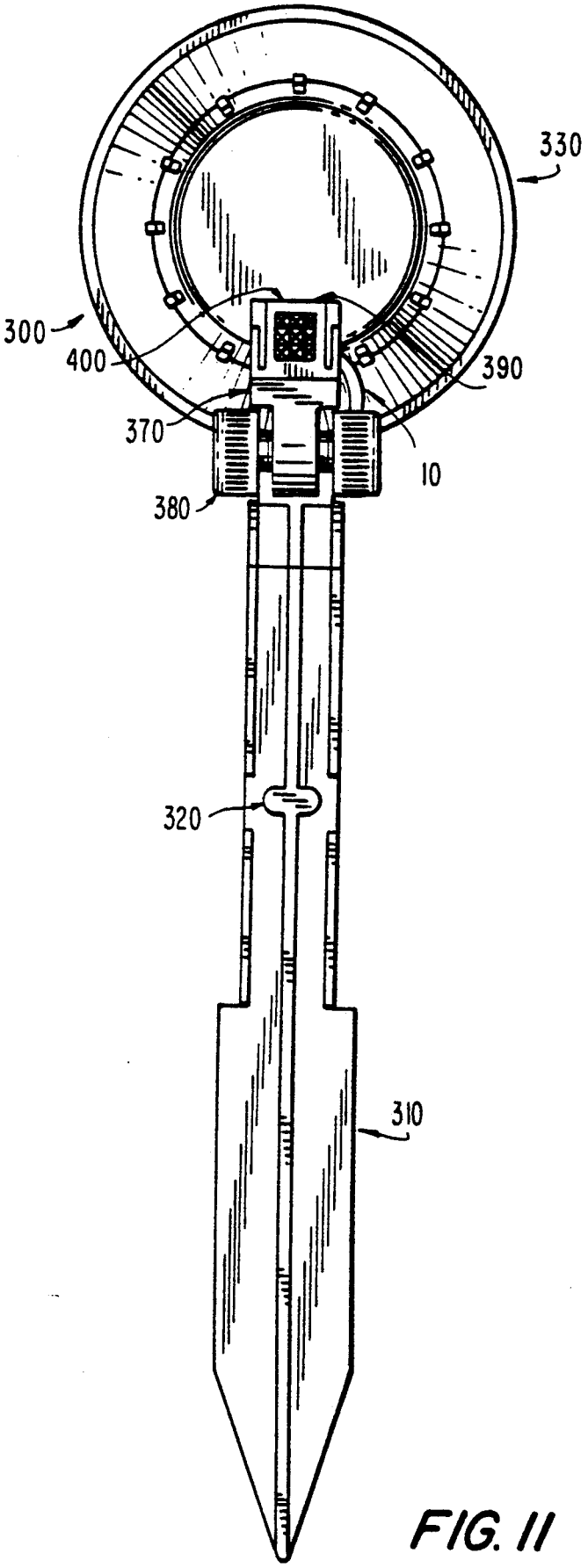
FIG. 11 is a rear view of the floodlight of FIG. 8.
Figure 13:
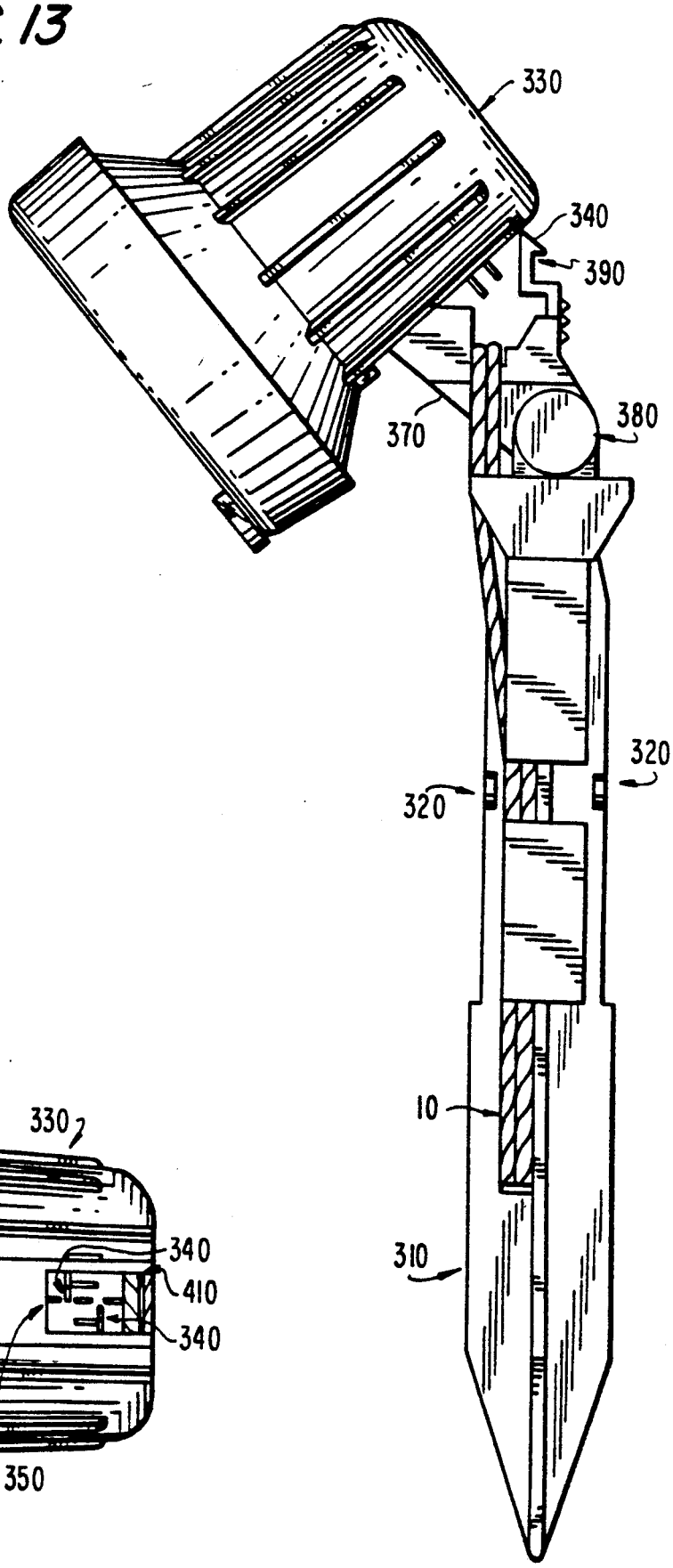
FIG. 13 is a side view of the floodlight of FIG. 9 with the cover assembly in an open position.
Figure 12:
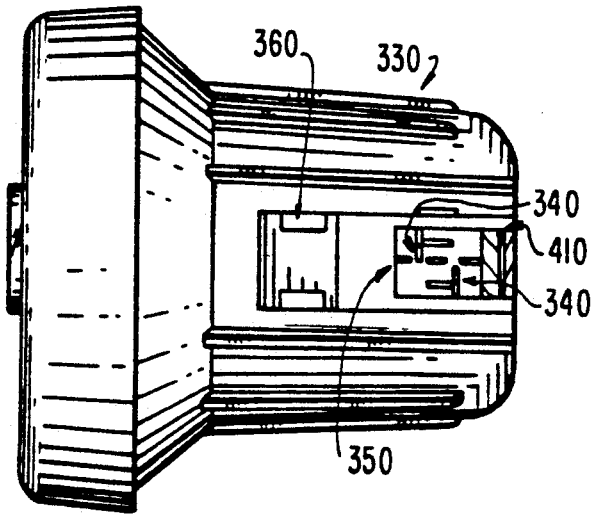
FIG. 12 is a bottom view of a floodlight cover assembly of a light fixture according to the present invention.

In a preferred embodiment, the bulb assembly 50 and stake 30 are inserted into an opening defined by the bottom of globe assembly 40. Lugs 116 on the top of the stake 30 penetrate matching slots 292 defined by ridges 293 inside the bottom of the globe assembly 40 (as depicted in FIG. 9). In use, the stake 30 then is rotated so that the lugs 116 engage the ridges 293. The globe assembly 40 is locked onto the stake 30 as two snap detent recesses 118 on the top of the stake 30 engage two matching detent bumps 294 on the bottom surfaces of the ridges 293 to prevent accidental disassembly. Engagement of the lugs 116 to the ridges 293 provides a compressive force on the snap portions of the bulb assembly such that a further lock for the hinge mechanism in addition to snap 260 is provided.

The bulb assembly may include features to assist in pivoting it to a closed position or to promote air ventilation inside the globe assembly 40. For example, FIGS. 2, 3, 5 and 8 show a shield tab 295. The shield tab 295 is oriented such that there is a small gap between it and snap prongs 270 allowing air to enter the inside of the globe 40 while blocking undesired light radiating from out of the bottom. Preferably the gap is narrow enough to prevent insects from entering the inside of the globe 40.

An alternate embodiment of the present invention is a floodlight 300 as depicted in FIGS. 10–13. The floodlight has a stake 310 with tabs 320 that are oriented on the stake to retain the wire 10 in place. A floodlight cover assembly 330 is provided. A light bulb is mounted in the cover assembly 330 such that light is emitted in the direction desired. The conductive prongs 340 preferably are mounted to the cover assembly 330 such that the pointed portion of the prongs 340 protrude from a prong housing 350 that is mounted to the cover assembly 330. Alternatively, the prong housing may be molded or otherwise attached to the cover assembly 330.

A hinge mechanism 360 is mounted to the stake 310 such that the floodlight cover assembly 330 may be moved with respect to the stake 310. Preferably, the stake 310 is connected through the hinge mechanism 360 to a bracket 370, rather than directly to the floodlight cover assembly 330. The floodlight cover assembly 330 is connected to the bracket 370 by a hinge 380 and a locking mechanism 390. Any type of hinge may be used such that the floodlight cover assembly 330 can pivot between an open and a closed position. The locking mechanism 390 holds the floodlight cover assembly 330 in place when it is in the closed position. The locking mechanism depicted in FIGS. 10–13 incorporates a snap 400 which fits into a slot in the floodlight cover assembly 330.

The bracket 370 also incorporates a channel 410 that is adapted to receive and position the wire 10 such that when the floodlight cover assembly 330 is pivoted about the hinge mechanism 360, the pointed portions of the conductive prongs 340 impinge upon and pierce the insulation of the wire, thereby forming a conductive contact.

Thus, it is seen that an outdoor light fixture with an angular displacement connector is provided. One skilled in the art will appreciate that the present invention can be practiced by other than the preferred embodiments which are presented for purposes of illustration and not of limitation, and the present invention is limited only by the claims which follow.

What is claimed is:

1. A light fixture that receives power through insulated wire means from an external power source comprising:

a support means for supporting the components of the light fixture and the insulated wire means;

a light source holding means mounted on the support means;

a light source means adapted to be held by the light source holding means; and an angular displacement connector mounted on the support means, said angular displacement connector being in conductive contact with said light source means and being adapted to provide a conductive contact with the insulated wire means, wherein the angular displacement connector comprises:

a bulb assembly, said bulb assembly comprising at least one conductive prong adapted to pierce the insulation of the insulated wire means, said conductive prongs being in conductive contact with the light source means; and hinge means operatively connected to the bulb assembly and the support means such that the bulb assembly can pivot between, an open position and a closed position.

2. The light fixture of claim 1 wherein said support means comprises a stake.

3. The light fixture of claim 2 wherein said stake comprises top and bottom ends, said bottom end being adapted to be inserted into the ground.

4. The light fixture of claim 1 wherein said support means comprises guide means for guiding and holding in place the insulated wire means.

5. The light fixture of claim 4 wherein said guide means comprises at least one stake channel.

6. The light fixture of claim 4 wherein said guide means comprises at least one tab.

7. The light fixture of claim 1 wherein said power source comprises a low voltage power supply.

8. The light fixture of claim 7 wherein the low voltage power supply provides between 8 and 40 volts AC through the wire.

9. The light fixture of claim 1 wherein the angular displacement connector further comprises means for guiding the insulated wire means into an orientation with respect to the conductive prongs such that when the bulb assembly is pivoted about the hinge means to the closed position, the conductive prongs pierce the insulation such that conductive contact is made between the conductive prongs and the conductive wire.

10. The light fixture of claim 9 wherein the means for guiding the insulated wire means comprises a channel at the top of the support means.

11. The light fixture of claim 1 wherein the angular displacement connector further comprises a securing means for securing the bulb assembly in the closed position.

12. The light fixture of claim 1 wherein the conductive prongs impinge upon the insulated wire means to exert a generally compressive force on the insulated wire means when the bulb assembly is pivoted from the open to the closed position.

13. The light fixture of claim 1 comprising two conductive prongs.

14. The light fixture of claim 1 wherein the bulb assembly is detachably connected to the support means by the hinge means.

15. The light fixture of claim 1 wherein the hinge means comprises:

at least one slot in the support means; and posts protruding from the bulb assembly, said posts being shaped and oriented such that a slidable and pivotable fit is provided with the slot in the support means.

16. A low voltage light fixture that receives power through insulated wire means from an external low voltage power source comprising:

a support means for supporting the components of the light fixture and the insulated wire means;

a light source holding means mounted on the support means;

a light source means adapted to be held by the light source holding means; and an angular displacement connector mounted on the support means, said angular displacement connector being in conductive contact with said light source means and being adapted to provide conductive contact with the insulated wire means, wherein the angular displacement connector comprises:

a bulb assembly, said bulb assembly comprising at least one conductive prong adapted to pierce the insulation of the insulated wire means, said conductive prongs being in conductive contact with the light source means; and hinge means operatively connected to the bulb assembly and the support means such that the bulb assembly can pivot between, an open position and a closed position.

17. A low voltage lighting system comprising:

at least one low voltage power supply;

an insulated wire means conductively connected to the low voltage power supply; and a plurality of light fixtures conductively connected to said insulated wire means wherein each of said light fixtures composes:

a support means for supporting the components of the light fixture and the insulated wire means;

a light source holding means mounted on the support means;

a light source means adapted to be held by the light source holding means; and an angular displacement connector mounted on the support means, said angular displacement connector being in conductive contact with said light source means and being adapted to provide a conductive contact with the insulated wire means, wherein the angular displacement connector comprises:

a bulb assembly, said bulb assembly comprising at least one conductive prong adapted to pierce the insulation of the insulated wire means, said conductive prongs being in conductive contact with the light source means; and hinge means operatively connected to the bulb assembly and the support means such that the bulb assembly can pivot between, an open position and a closed position.

18. A floodlight that receives power through insulated wire means from an external power source comprising:

a support means for supporting the components of the floodlight;

a floodlight cover assembly mounted on the support means;

a light source means adapted to be held within the floodlight cover assembly; and an angular displacement connector mounted to the floodlight cover assembly, said angular displacement connector being in conductive contact with said light source means and being adapted to provide a conductive contact with the insulated wire means, wherein the angular displacement connector comprises:

a bulb assembly, said bulb assembly comprising at least one conductive prong adapted to pierce the insulation of the insulated wire means, said conductive prongs being in conductive contact with the light source means; and hinge means operatively connected to the bulb assembly and the support means such that the bulb assembly can pivot between, an open position and a closed position.

* * * * *